US010621965B2

(12) United States Patent
Abiko

(10) Patent No.: US 10,621,965 B2
(45) Date of Patent: Apr. 14, 2020

(54) ACOUSTIC APPARATUS

(71) Applicant: Hiroshi Abiko, Yonezawa (JP)

(72) Inventor: Hiroshi Abiko, Yonezawa (JP)

( * ) Notice: Subject to any disclaimer, the term of this patent is extended or adjusted under 35 U.S.C. 154(b) by 0 days.

(21) Appl. No.: 16/349,614

(22) PCT Filed: Dec. 4, 2016

(86) PCT No.: PCT/JP2016/085992
§ 371 (c)(1),
(2) Date: May 14, 2019

(87) PCT Pub. No.: WO2018/100754
PCT Pub. Date: Jun. 7, 2018

(65) Prior Publication Data

US 2019/0279608 A1 Sep. 12, 2019

(51) Int. Cl.
*G10H 3/22* (2006.01)
*G10H 3/12* (2006.01)
(Continued)

(52) U.S. Cl.
CPC ..... *G10H 3/22* (2013.01); *G10D 3/02* (2013.01); *G10D 3/04* (2013.01); *G10G 5/00* (2013.01);
(Continued)

(58) Field of Classification Search
CPC ..... G10D 3/02; G10D 1/08; G10D 1/085; G10H 2220/461; G10H 1/00; G10H 1/047; G10H 5/00; G10H 5/02; G10K 15/00; G10K 11/004; G10C 3/06
See application file for complete search history.

(56) References Cited

U.S. PATENT DOCUMENTS 4,501,186 A * 2/1985 Ikuma ..... G10H 3/182 84/726
9,691,363 B2 * 6/2017 McHugh ..... G10D 3/00
(Continued)

FOREIGN PATENT DOCUMENTS

CN 101263550 A 9/2008
JP H09-247779 A 9/1997
(Continued)

OTHER PUBLICATIONS

International Search Report for PCT/JP2016/085992 dated Feb. 21, 2017.
(Continued)

*Primary Examiner* — Marlon T Fletcher
(74) *Attorney, Agent, or Firm* — Yokoi & Co., U.S.A.; Toshiyuki Yokoi

(57) ABSTRACT

The present invention provides an acoustic apparatus which can be attached to the musical instrument without adding processing to reproduce. After the acoustic apparatus is detached, the user can enjoy playing the musical instrument itself same as before the acoustic apparatus is attached. An acoustic apparatus 1 has a vibration generator 2, a support body 3, a locking portion 4 and a drive circuit 5. The acoustic apparatus 1 is locked to a neck holder 301 of a stand 300, and a diaphragm 201 of the vibration generator 2 is arranged to face a sound hole 109 of a guitar 100. The drive circuit 5 drives the vibration generator 2 according to the inputted sound signal to resonate a sound box 103. Thus, rich sound can be reproduced.

9 Claims, 15 Drawing Sheets

(51) Int. Cl.

| | |
|---|---|
| ***G10D 3/02*** | (2006.01) |
| ***G10D 3/04*** | (2020.01) |
| ***G10H 3/14*** | (2006.01) |
| ***H04R 1/24*** | (2006.01) |
| ***H04R 1/00*** | (2006.01) |
| ***G10H 1/32*** | (2006.01) |
| ***H04R 1/02*** | (2006.01) |
| ***G10G 5/00*** | (2006.01) |
| *G10D 1/08* | (2006.01) |
| *G10D 1/02* | (2006.01) |

(52) U.S. Cl.
CPC ..... *G10H 1/32* (2013.01); *G10H 3/146* (2013.01); *H04R 1/00* (2013.01); *H04R 1/02* (2013.01); *H04R 1/24* (2013.01); *G10D 1/02* (2013.01); *G10D 1/08* (2013.01); *G10H 2220/461* (2013.01)

(56) References Cited

U.S. PATENT DOCUMENTS

| | | | | |
|---|---|---|---|---|
| 2002/0114481 | A1* | 8/2002 | Watanabe | H04R 1/02 381/334 |
| 2003/0019349 | A1* | 1/2003 | Green | G10D 1/085 84/731 |
| 2008/0190260 | A1 | 8/2008 | Lye | |
| 2015/0356960 | A1* | 12/2015 | Webman | G10H 3/18 84/630 |
| 2016/0140941 | A1* | 5/2016 | Kobayashi | G10F 1/16 84/3 |
| 2018/0240444 | A1* | 8/2018 | Israel | G10H 3/143 |
| 2019/0279608 | A1* | 9/2019 | Abiko | H04R 1/24 |

FOREIGN PATENT DOCUMENTS

| | | | |
|---|---|---|---|
| JP | 2002-247676 | A | 8/2002 |
| JP | 2009-505137 | A | 2/2009 |
| JP | 3188252 | U | 1/2014 |
| JP | 5849172 | B | 1/2016 |
| JP | 2016-045316 | A | 4/2016 |

OTHER PUBLICATIONS

PCT written opinion dated Feb. 21, 2017.
Chinese Office Action dated Nov. 27, 2019.

* cited by examiner

ACOUSTIC APPARATUS

TECHNICAL FIELD

The present invention relates to an acoustic apparatus for resonating a musical instrument having a sound box.

BACKGROUND ART

Conventionally, a speaker apparatus is known as an apparatus for converting a sound signal composed of music data of musical sound and voice into air vibration (sound electromechanical transducer). The speaker apparatus used widely in general is formed by: a speaker unit having a cone-shaped diaphragm for converting the sound signal into air vibration; and an enclosure (housing). Various efforts have been conventionally made to make the sound emitted from the speaker apparatus close to the original sound.

As an example, it is known that a speaker apparatus formed by directly arranging a speaker unit on a musical instrument for reproducing rich sound inherent in the musical instrument. For example, Patent Document 1 and Patent Document 2 disclose a speaker apparatus where a speaker unit is attached to a sound box or a sound hole of an acoustic guitar as a vibration generation source to use the sound box as an enclosure.

PRIOR ART DOCUMENTS

Patent Documents

Patent Document 1: Japanese Unexamined Patent Application Publication No. 2002-247676

Patent Document 2: Japanese Utility Model Registration No. 3188252

Patent Document 3: Japanese Unexamined Patent Application Publication No. 2016-45316

DISCLOSURE OF THE INVENTION

Problems to be Solved by the Invention

However, in Patent Documents 1 and 2, the speaker unit is directly installed by adding processing to the sound box of the guitar using a screw or an adhesive agent, for example. The musical instruments are commonly expensive, and it is assumed that people who enjoy playing the guitar refrain from adding processing to the precious musical instruments. There is a problem that the original sound of the musical instrument before the processing cannot be reproduced any more if the processing is once added. There is another problem that the weight of the speaker unit is added to the sound box and therefore the originally expected free vibration is restricted.

In Patent Document 2, since a sound hole of the guitar is closed with the speaker unit, the sound emitted from the sound hole and Helmholtz resonance caused by the sound box and the sound hole cannot be utilized. Thus, the sound inherent in the musical instrument cannot be sufficiently reproduced. Furthermore, as described in Patent Document 2, the strings can be vibrated only for open strings when the sound box is resonated in a state that the strings are installed. Thus, there is a problem that vibration sound not corresponding to the pitch of the musical instrument is generated.

On the other hand, Patent Document 3 discloses the method of emitting sound by resonating the sound box by a vibrator without adding processing to a stringed instrument.

However, the sound signal generally contains the sound other than the sound of stringed instrument. When the sound box is resonated by the vibrator, other sound than the resonance sound of the sound box cannot be reproduced and performance of generating the sound signal is not enough.

The present invention is made for solving the above described problems. The apparatus of the present invention can be attached to the musical instrument having the sound box without adding processing. The rich sound inherent in the musical instrument can be reproduced. After the apparatus is detached, the user can enjoy playing the musical instrument itself same as before the apparatus is attached. In addition, the present invention aims for providing an acoustic apparatus for reproducing rich sound including the sound other than the sound of the musical instrument to which the acoustic apparatus is attached by emitting the sound from the acoustic apparatus itself.

Means for Solving the Problem

In order to achieve the above described purpose, one embodiment of the present invention is an acoustic apparatus for resonating a musical instrument having a sound box to emit a sound wave from the musical instrument, the acoustic apparatus has: a vibration generator which is configured to be arranged to face the sound box; a support body for supporting the vibration generator; and a locking portion which is configured to be locked directly to the musical instrument or locked to a stand for holding the musical instrument. By using the present invention, rich sound can be reproduced by resonating the musical instrument having the sound box.

The musical instrument having the sound box can be percussion instruments such as a drum with a membrane mounted on a circular frame. However, the present invention is suitably available for stringed instruments with strings and a sound hole such as a guitar and violin.

In another embodiment of the present invention, the musical instrument further has a sound hole, and the vibration generator is configured to be arranged to face the sound hole from an outside of the musical instrument. By using the present invention, rich sound inherent in the musical instrument can be reproduced by effectively resonating the musical instrument having the sound hole.

In another embodiment of the present invention, the acoustic apparatus further has a spacer which is configured to be arranged between the sound box and the support body. By using the present invention, rich sound can be reproduced since the clearance between the sound box and the vibration generator can be maintained appropriately.

In another embodiment of the present invention, the acoustic apparatus further has a tweeter which is arranged on the support body to emit the sound wave toward an opposite direction of the vibration generator. By using the present invention, high frequency range sound blocked by the vibration generator and the support body is compensated and all ranges of the inputted sound signal are emitted toward the listener. Thus, performance of generating the sound signal can be further improved.

In another embodiment of the present invention, the acoustic apparatus further has a drive circuit for outputting a sound driving signal to the vibration generator. By using the present invention, rich sound can be reproduced by driving the vibration generator and the tweeter for resonating the sound box.

In another embodiment of the present invention, the drive circuit drives the vibration generator so that the sound wave emitted from the vibration generator and the sound wave emitted from the tweeter have a synchronized phase in a direction of emitting the sound wave from the sound box. By using the present invention, since the phase of the sound wave emitted from the vibration generator toward the listener is synchronized with (same as) the phase of the sound wave emitted from the tweeter toward the listener, incompatibility caused by the phase difference can be suppressed. Thus, the inputted sound signal can be more conveniently reproduced.

In another embodiment of the present invention, the drive circuit has: a phase inverting unit for inverting the phase of the sound driving signal with respect to the sound driving signal outputted to the tweeter; or a phase adjusting unit for adjusting the phase of the sound driving signal. By using the present invention, the phase of the sound wave emitted from the tweeter can be freely and easily adjusted according to the phase of the sound wave emitted from the vibration generator and the sound box. Thus, the inputted sound signal can be more conveniently reproduced.

In another embodiment of the present invention, the acoustic apparatus further has a shielding member which is configured to be arranged between the vibration generator and the musical instrument to surround an outer periphery of the vibration generator. By using the present invention, the excessively emphasized or attenuated frequency component generated by the interference of the sound wave emitted from the sound box and the vibration generator is suppressed. Thus, the original sound of the musical instrument can be faithfully reproduced.

In another embodiment of the present invention, the musical instrument further has a plurality of strings, and the acoustic apparatus further has a vibration damping member which is in contact with the plurality of strings. By using the present invention, unnecessary vibration sound emitted from the strings is suppressed. Thus, the original sound of the musical instrument can be faithfully reproduced.

Another embodiment of the present invention is a musical instrument system, having: a musical instrument having a sound box; and an acoustic apparatus for resonating the musical instrument. By using the present invention, a musical instrument system capable of reproducing rich sound inherent in the musical instrument can be provided.

Effects of the Invention

The apparatus of the present invention can be attached to the musical instrument having the sound box without adding processing. The rich sound inherent in the musical instrument can be reproduced. After the apparatus is detached, the user can enjoy playing the musical instrument itself same as before the apparatus is attached. In addition, rich sound including the sound other than the sound of the musical instrument to which the apparatus is attached can be reproduced by emitting the sound wave from the acoustic apparatus itself.

MODES FOR CARRYING OUT THE INVENTION

Figure 1B:
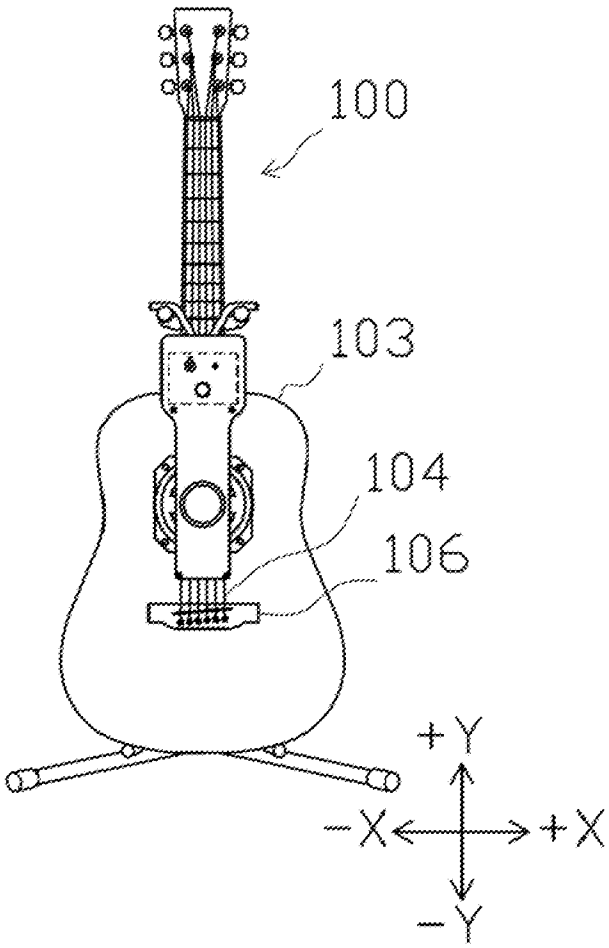
FIG. 1A is a side view and FIG. 1B is a front view of an acoustic apparatus of the present embodiment installed on a musical instrument.

Hereafter, the embodiments of the present invention will be explained referring to the drawings.

Embodiment 1

Figure 1A:
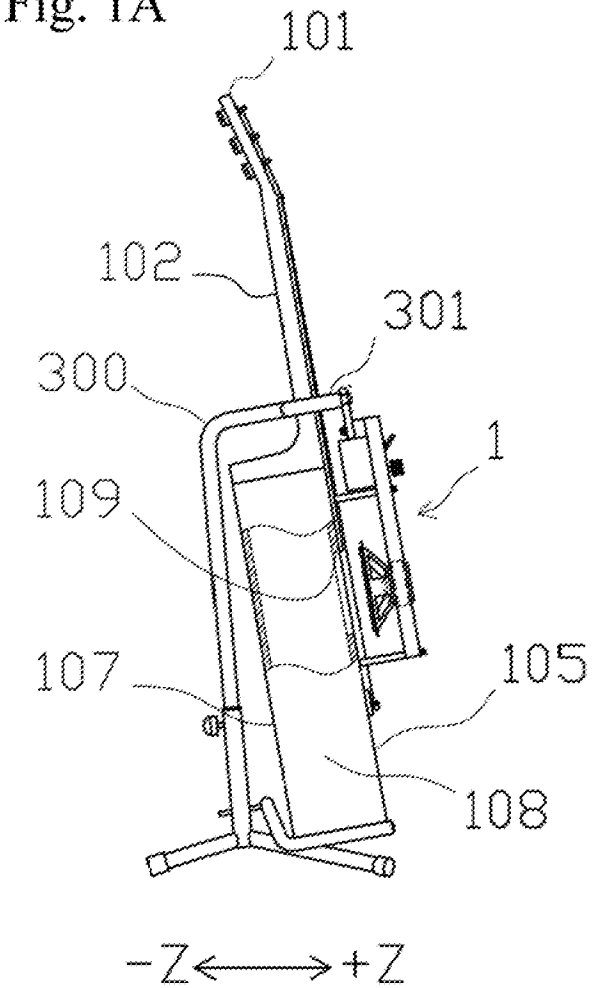

FIG. 1A is a side view and FIG. 1B is a front view of an acoustic apparatus 1 of the present embodiment installed on a musical instrument (guitar) 100. As shown in FIGS. 1A and 1B, when a sound hole 109 of the guitar 100 is considered to be a center, a width direction of the guitar 100 is defined as an X direction, a direction of a head 101 is defined as a Y direction, and a thickness direction of a sound box 103 is defined as a Z direction. The right direction of the sound hole 109 is defined as +X while the left direction is defined as −X in the X direction. The direction of the head 101 is defined as +Y while the direction of a bridge 106 is defined as −Y in the Y direction. The direction of a front plate 105 is defined as +Z while the direction of a back plate 107 is defined as −Z in the Z direction. Note that the +Z direction, which is the direction of emitting the sound wave, is defined as a listener direction. The above described definitions are same in FIG. 2A and the following figures.

The acoustic apparatus 1 is an apparatus for resonating a sound box of a stringed instrument having the sound box and a sound hole to emit a sound wave from the stringed instrument. An acoustic guitar 100 is shown as an example of the musical instrument to which the acoustic apparatus 1 is attached. A stand 300 is shown as an example of a support body of the acoustic guitar. The guitar 100 is supported by the stand 300 in a state of being inclined slightly backward. Note that the musical instrument to be resonated to emit a sound wave by the acoustic apparatus 1 of the present invention is not limited to the acoustic guitar. Any stringed instruments can be used as long as the sound box and the sound hole are provided. For example, a violin, a ukulele and a mandolin can be used. In addition, the stringed instruments can have a sound electromechanical transducer such as a pickup.

As shown in FIGS. 1A and 1B, the guitar 100 is formed by a head 101, a neck 102, a sound box 103 and strings 104. The sound box 103 is formed by a front plate 105, a bridge 106, a back plate 107 and a side plate 108. A sound hole 109 is formed on the front plate. The strings 104 are stretched between the head 101 and the bridge 106.

Figure 2B:
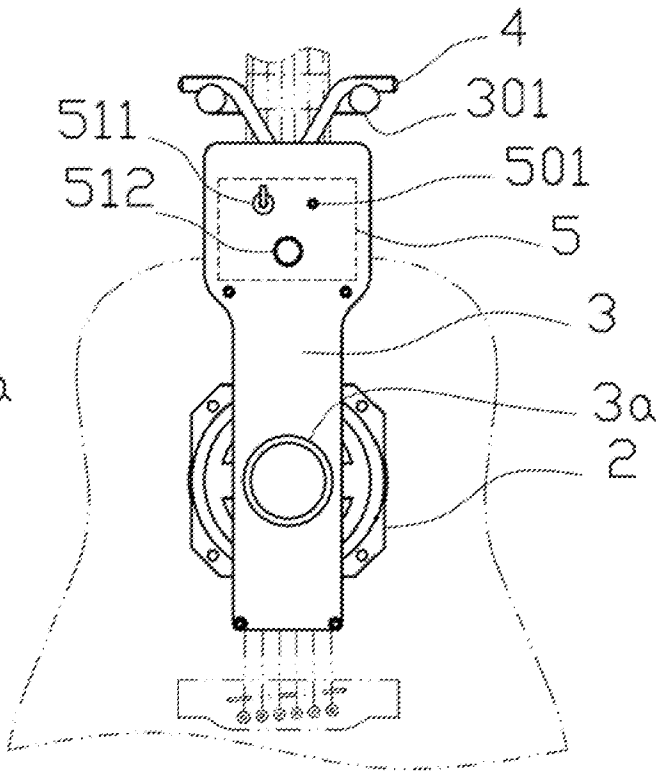
FIG. 2A is a side view and FIG. 2B is a front view showing a detail of the acoustic apparatus of the present embodiment.
Figure 2A:
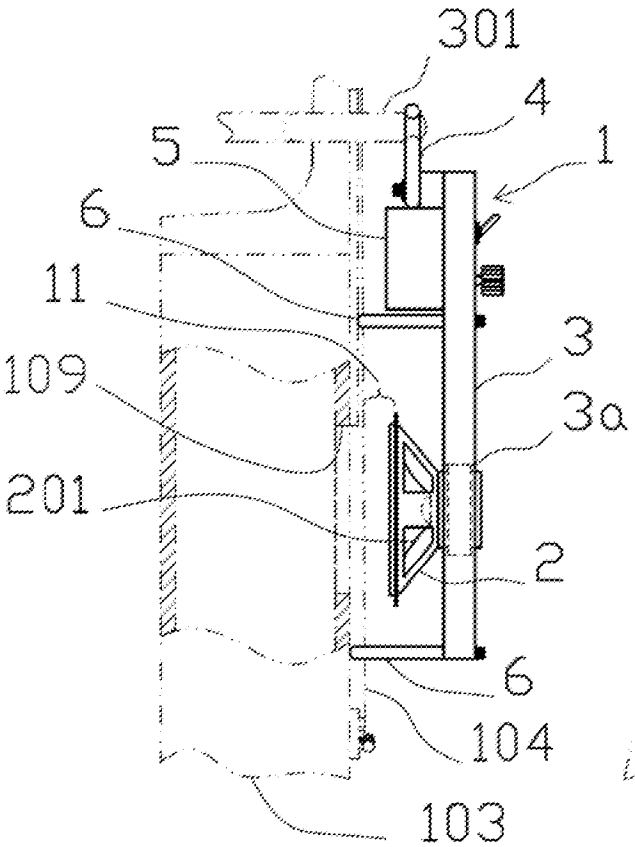

FIG. 2A is a side view and FIG. 2B is a front view for explaining the acoustic apparatus 1 of the present embodiment in detail. The acoustic apparatus 1 is formed by a vibration generator 2, a support body 3 for supporting the vibration generator 2, a locking portion 4 for locking the acoustic apparatus 1 to a neck holder 301 of the stand 300, a drive circuit 5 for driving the vibration generator 2 according to the inputted sound signal, and a spacer 6 which is arranged to be in contact with the front plate 105 for appropriately keeping a clearance 11 between the vibration generator 2 and the front plate 105.

The drive circuit 5 has a power switch 511, a volume adjusting knob 512 and an input terminal 501 of the sound signal. The user can start and stop the drive circuit 5 by the power switch 511. The sound signal inputted in the input terminal 501 is amplified by the later described amplifier 502, and a sound driving signal adjusted by the volume adjusting knob 512 is outputted to the vibration generator 2.

In FIG. 2A, the vibration generator 2 inserted into a mounting hole 3*a* formed on the support body 3 and fixed by an adhesive agent or the like is spaced apart from the front surface of the sound hole 109 of the guitar 100 so that a front surface 201*a* of a diaphragm 201 is arranged to face the front surface of the sound hole 109. The diaphragm 201 of the vibration generator 2 converts the sound driving signal of the inputted sound signal into an acoustic vibration to emit a sound wave. The vibration generator 2 resonates the sound box 103 via the sound hole 109 of the guitar 100 using a part of the sound wave emitted from the diaphragm 201.

Figure 3:
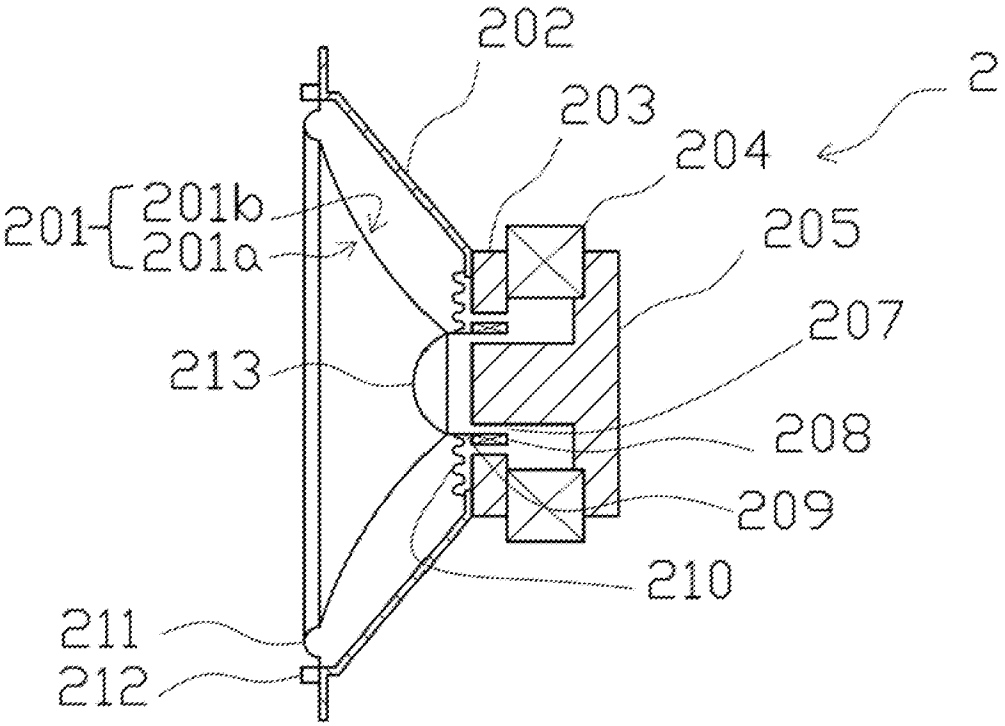
FIG. 3 is a side view of a vibration generator of the present embodiment.

FIG. 3 is a cross-sectional view of a dynamic type speaker unit which is suitably used as the vibration generator 2 of the present embodiment. The dynamic type speaker unit is formed, for example, by: a cone-shaped diaphragm 201 for converting the sound driving signal of the sound signal into the acoustic vibration; a frame 202 for supporting the entire speaker unit; a plate 203 mounted on the rear surface of the frame 202 for forming a magnetic circuit; a magnet 204 mounted on the rear surface of the plate; a yoke 205 mounted on the rear surface of the magnet 204; a pole part 206 of the yoke 205; a voice coil 208 and a voice coil bobbin 209 which are inserted into a magnetic gap 207 of the plate 203; a damper 210 provided on an outer periphery of the voice coil bobbin; a ring-shaped edge 211 adhered to the outer periphery of the cone-shaped diaphragm 201; a ring-shaped gasket 212 adhered to the outer periphery of the ring-shaped edge 211; and a center cap 213 mounted on the inner periphery of the diaphragm 201. Although it is not illustrated, a lead wire for imposing the sound driving signal is connected with the voice coil 208. Note that the front surface of the diaphragm to which the center cap 213 is attached is defined as 201*a*, and the reverse surface is defined as 201*b*.

The vibration generator 2 is not limited to the above described dynamic type speaker unit. Any vibration generators such as a magnetic type, an electrostatic type and a piezoelectric type can be used as long as the vibration generator can convert the sound driving signal into the acoustic vibration. The diaphragm is not limited to the cone-shaped. A dome-shaped diaphragm and a flat-shaped diaphragm can be also used. When the vibration generator 2 is the dynamic type speaker unit or the like having a permanent magnet, a magnetic shielding type is preferred to prevent leakage of magnetic flux.

By using the present embodiment, the acoustic apparatus 1 is locked to the stand 300 by the locking portion 4, and the sound box 103 is resonated. Thus, rich sound can be reproduced without adding processing to the musical instrument. In addition, the acoustic apparatus 1 can be easily detached. After the acoustic apparatus 1 is detached, the user can enjoy playing the musical instrument itself same as before the acoustic apparatus 1 is attached.

Embodiment 2

Figure 4B:
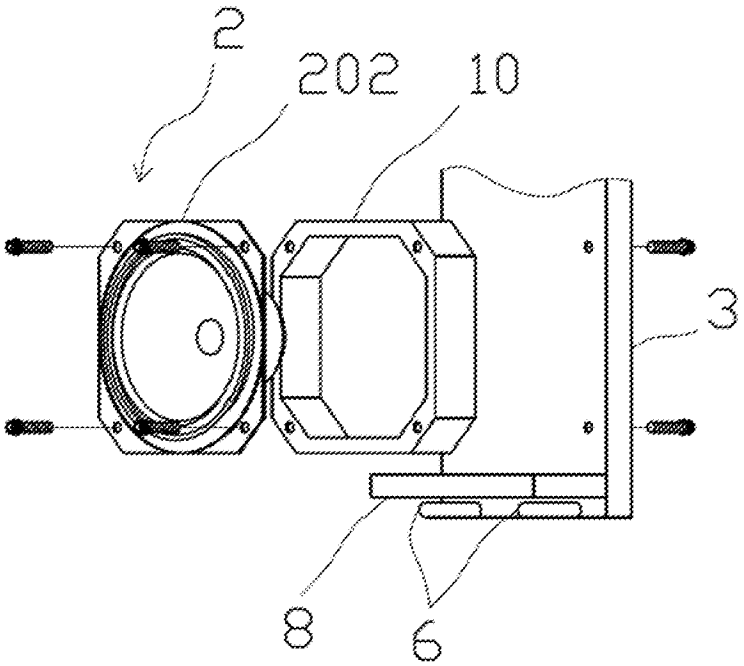
FIGS. 4A and 4B are perspective views related to a method of installing the vibration generator shown in FIG. 3 to the acoustic apparatus.
Figure 4A:
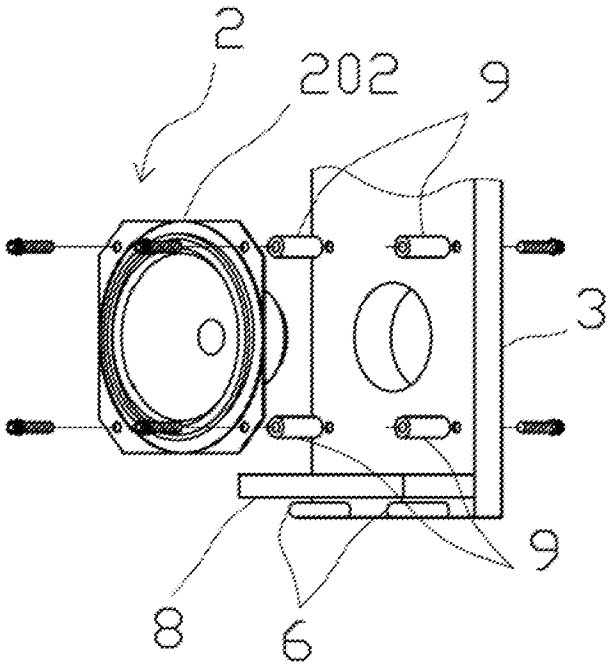

FIGS. 4A and 4B are perspective views related to a method of installing the vibration generator 2 of the present embodiment. As shown in FIG. 4A, the vibration generator 2 can be more stably installed by fixing the frame 202 to the support body 3 via a spacer 9 for supporting frame using a screw or the like. As shown in FIG. 4B, it is also possible to attach a frame 10 to the support body 3 for forming an enclosure and attach the vibration generator 2 to the frame 10. Furthermore, although it is not illustrated, when a speaker grill (protection net) is provided on the front surface of the vibration generator 2, the breakage of the diaphragm 201 can be prevented. In addition, a bass reflex port can be provided on the enclosure.

By using the present embodiment, the vibration generator 2 can be firmly installed on the support body 3. Thus, the sound can be improved and the breakage of the vibration generator 2 can be prevented.

Embodiment 3

Figure 5B:
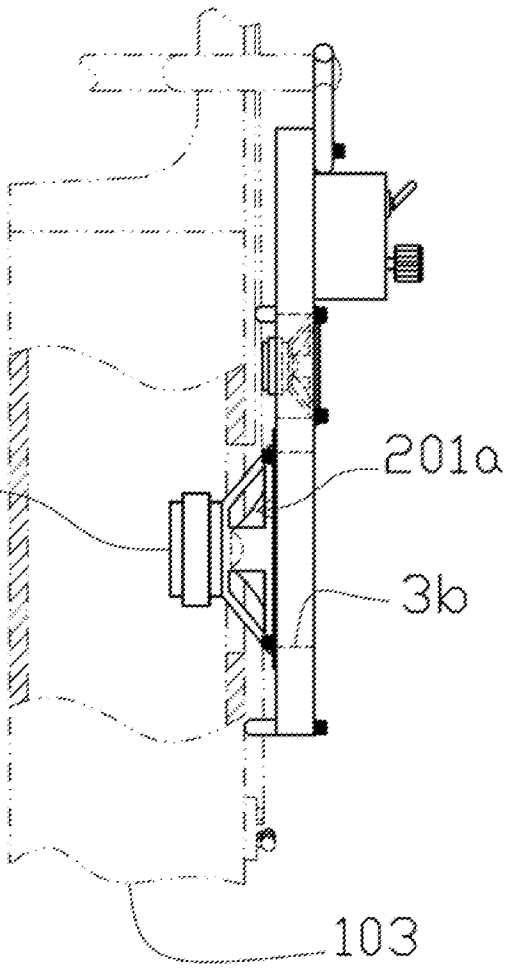
FIGS. 5A and 5B are side views of the acoustic apparatus including a tweeter of the present embodiment.
Figure 5A:
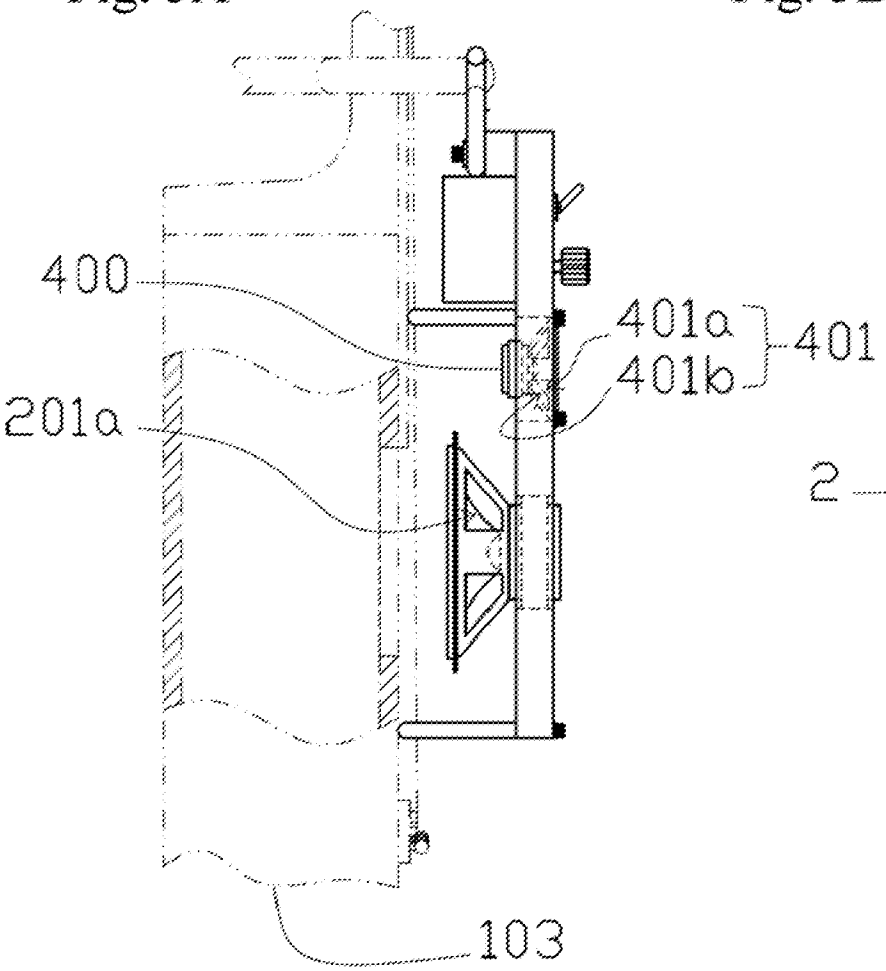

FIGS. 5A and 5B are side views of the acoustic apparatus 1 of the present embodiment on which a tweeter 400 is installed. The sound wave emitted from the sound box 103 and the vibration generator 2 to the listener side (+Z direction) is obstructed by the components of the vibration generator 2 such as the frame 202, the magnet 204 and the yoke 205 and the support body 3, for example. This is remarkable as the frequency is higher. Therefore, as shown in FIG. 5A, the tweeter 400 for emitting high frequencies is installed so that a surface 401*a* of a diaphragm 401 is arranged to face (directed toward) the listener side (+Z direction). Thus, the high frequency ranges of the sound wave emitted toward the listener side can be compensated. Note that a reverse surface of the diaphragm 401 is shown as 401*b*.

Same as the installation of the tweeter 400, as shown in FIG. 5B, the vibration generator 2 can be installed aligning with a sound emitting hole 3*b* formed on the support body 3 so that the front surface 201*a* of the diaphragm is arranged to face (directed toward) the listener side (+Z direction). Especially, when the strings 104 are not stretched, a part of the vibration generator 2 can be inserted in the sound box 103. Thus, the acoustic apparatus 1 can be especially made compact. Although it is not illustrated, a squawker for emitting midrange frequencies can be also installed same as the tweeter 400. The vibration generator 2 and the tweeter 400 are preferably arranged adjacent to each other because localization of the sound image become worse if the distance between the vibration generator 2 and the tweeter 400 is long, In order to avoid the obstruction of the sound wave emitted toward the listener side, a width (Y direction) of the support body 3 of the vibration generator 2 is preferably as short as possible within the range of securing necessary rigidity.

By using the present embodiment, all frequencies of the inputted sound signal are emitted toward the listener direction. Thus, performance of reproducing the sound signal can be further improved. In addition, rich sound including the sound other than the sound of the musical instrument to which the acoustic apparatus is attached can be reproduced by emitting the sound wave from the acoustic apparatus itself.

Embodiment 4

In FIG. 2, the sound pressure of the emitted sound wave is reduced as the size of the diaphragm 201 of the vibration generator 2 becomes small with respect to the diameter of the sound hole 109. Consequently, resonance effect reduces. On the contrary, the resonance sound is obstructed more as the size of the diaphragm 201 becomes large with respect to the diameter of the sound hole 109. Therefore, it is preferred that the size of the vibration generator 2 is approximately as large as the diameter of the sound hole 109. However, the size is not limited to the above described size since the balance between the sound wave emitted from the vibration generator 2 and the sound wave emitted from the sound box 103 can be arbitrarily selected according to the resonance state and the listener's preference.

It is preferred that the center of the vibration generator 2 is substantially aligned with the center of the sound hole 109. However, it is also possible to arrange the diaphragm 201 of the vibration generator 2 so as to overlap with only a part of an opening of the sound hole 109 as long as the vibration generator 2 can resonate the sound box 103. The vibration generator 2 can be displaced to the left/right (X direction) of the sound hole 109, the direction (Y direction) of the neck 102/bridge 106 or both of the above described directions.

The clearance 11 between the vibration generator 2 and the sound hole 109 is not particularly limited as long as the sound box 103 can be resonated. However, the clearance 11 is preferably 100 mm or less, more preferably 50 mm or less.

When the vibration generator 2 is a cone type speaker unit, the sound wave emitted toward the direction (−Z direction) of the front surface 201*a* of the diaphragm and the sound wave emitted toward the direction (+Z direction) of the reverse surface 201*b* are opposite phases to each other. Therefore, the sound waves are diffracted due to diffraction phenomenon and mutually canceled. In particular, attenuation is remarkable at the low frequencies. In a general speaker apparatus, the speaker unit is attached to a flat baffle or an enclosure to prevent the diffraction of the sound. In the present invention, the sound box 103 of the guitar 100 emits the resonance sound and also functions as the enclosure of the vibration generator 2. Thus, the low frequencies can be increased. The effect of preventing the diffraction of the sound can be obtained even when the vibration generator 2 is not in contact with the sound hole and the sound hole is not hermetically sealed. The effect is greater when the clearance 11 is smaller.

By using the present embodiment, the balance and volume of the sound waves emitted from the sound box 103 and the vibration generator 2 can be optimized. Thus, the original sound of the musical instrument can be sufficiently reproduced.

Embodiment 5

Figure 6:
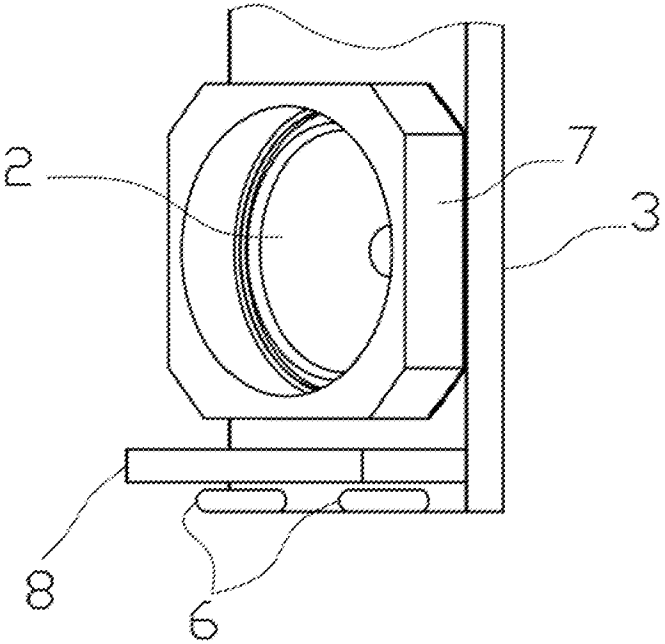
FIG. 6 is a perspective view of a shielding member of the present embodiment.

FIG. 6 is a perspective view of a shielding member 7 of the present embodiment viewed from the guitar 100 to the listener direction (+Z direction). When the clearance 11 between the vibration generator 2 and the sound hole 109 is changed, the resonance state of the sound box 103 varies. Therefore, the clearance 11 can be arbitrarily selected according to the listener's preference. However, in some cases, a specified frequency component of the resonance sound is unnecessarily increased. In other cases, a specified frequency component is unnecessarily increased or decreased when the sound waves emitted from the front surface 201*a* and the reverse surface 201*b* of the diaphragm and the resonance sound of the sound box 103 are complicatedly interfered with each other. Therefore, it is preferred that the shielding member 7 is installed between the vibration generator 2 and the front plate 105 of the sound box 103 for adjusting the strength of the resonance sound emitted from the sound hole 109 so that the shielding member 7 surrounds around an approximately outer circumference of the vibration generator 2. Note that the shielding member 7 is not needed when the influence of the interference of the sound is small enough with respect to the reproduced musical sound.

By using the present embodiment, the unnecessarily increased or decreased frequency component is suppressed by the shielding member 7. Thus, the original sound of the musical instrument can be faithfully reproduced.

The location of installing the shielding member 7 is not limited to the vibration generator 2. The shielding member 7 can be installed on the support body 3 of the vibration generator 2 or the frame 10 of the vibration generator 2. An elastic body having high flexibility is used for the shielding member 7 in order not to suppress the vibration of the front plate 105, the shielding member 7 can be in contact with the front plate 105. As for the material of the shielding member 7, a flexible urethane foam and EPDM (Ethylene Propylene Diene Monomer) rubber foam are suitably used since they are porous and have a large internal loss. However, the material is not limited to the above described materials. Any materials can be used as long as the material can shield, absorb or attenuate the sound.

Embodiment 6

Figure 7B:
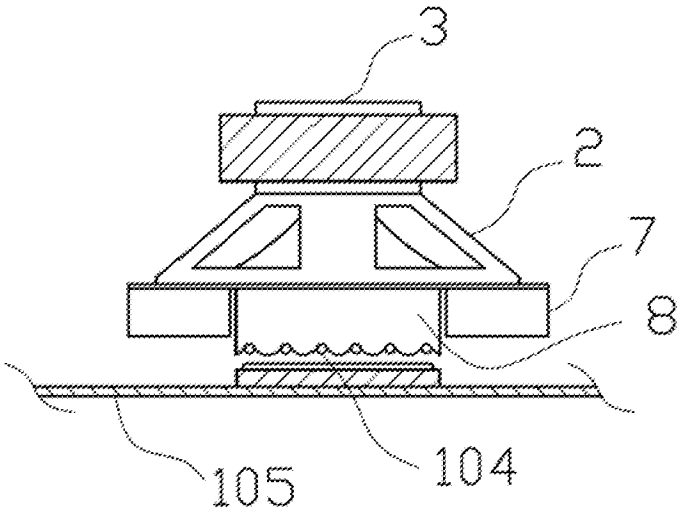
FIG. 7B is a cross-sectional view of an arrangement of the vibration damping member.
Figure 7A:
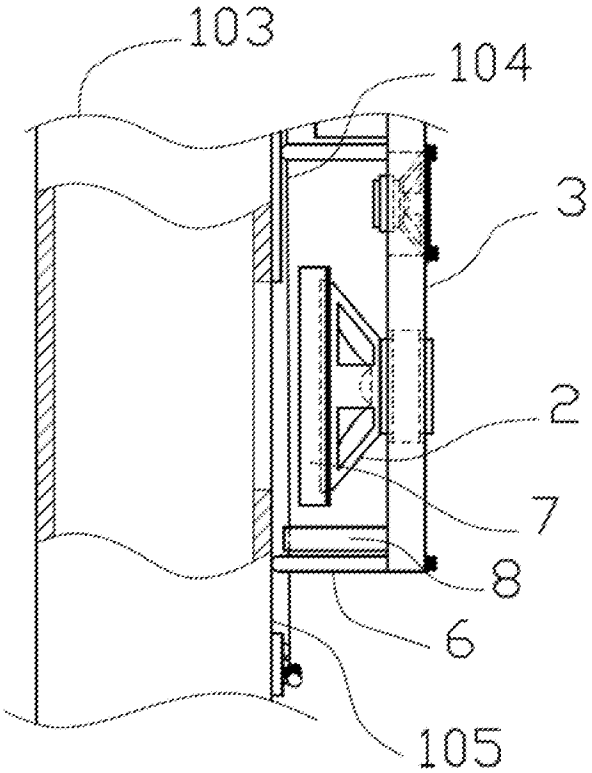
FIG. 7A is a side view of a vibration damping member of the present embodiment.
Figure 7C:
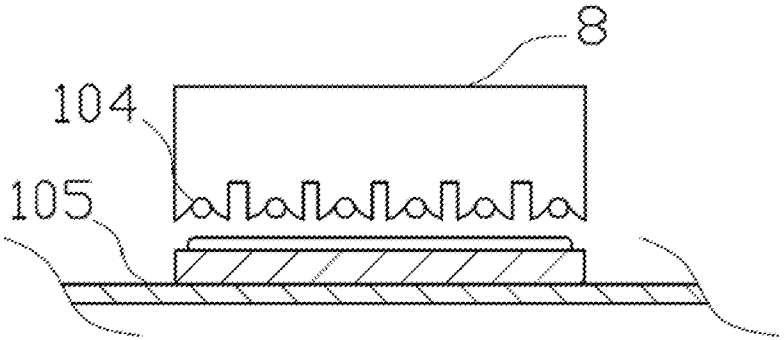
FIGS. 7C and 7D are cross-sectional views related to a shape and a configuration of the vibration damping member.
Figure 7D:
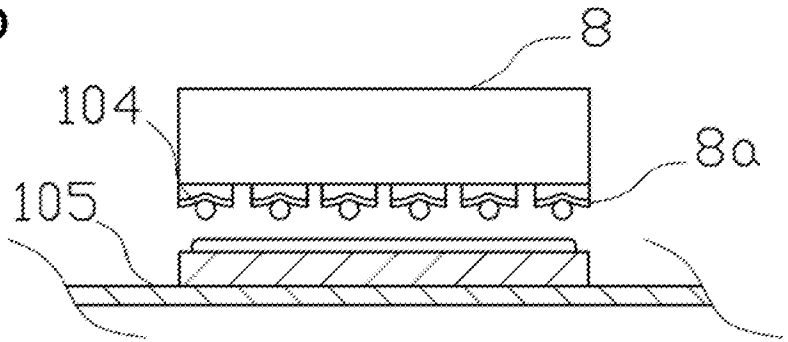

FIG. 7A shows a side view of a vibration damping member 8 of the present embodiment. FIG. 7B shows a cross-sectional view viewed from the bridge 106 (location of installation) to the neck 102 (+Y direction). FIGS. 7C and 7D are cross-sectional views related to a shape and a configuration. When the sound box 103 is resonated by the sound wave emitted from the vibration generator 2, the strings 104 stretched between the head 101 and the bridge 106 are also vibrated. However, the strings 104 are vibrated in a state of the open strings. Thus, unnecessary vibration sound not corresponding to the pitch of the musical instrument is generated. Therefore, as shown in FIG. 7A, the vibration damping member 8 is installed on the support body 3 of the vibration generator 2 by using an adhesive agent or the like. Since the vibration damping member 8 is in contact with the strings 104, unnecessary vibration sound of the strings 104 can be suppressed. Note that the vibration damping member 8 is not necessary when unnecessary vibration sound is negligibly small with respect to the resonance sound emitted from the sound box 103, when the strings 104 are loosened enough, or when the strings 104 are not installed.

As for the material of the vibration damping member 8, rigid bodies such as metal, synthetic resin and wood can be used. However, elastic bodies capable of deforming are preferred so that an appropriate pressure is applied to the strings 104 when the vibration damping member 8 is in contact with the strings 104. FIG. 7A shows the state that the vibration damping member 8 is in contact with the strings 104 and the vibration damping member 8 is deformed appropriately. The later described FIGS. 7B, 7C and 7D also show the appropriately deformed state.

The location of installation of the vibration damping member 8 is not limited to the support body 3. As shown in FIG. 7B, the vibration damping member 8 can be installed on the vibration generator 2 as a part of the shielding member 7. Although it is not illustrated, the vibration damping member 8 can be installed on the drive circuit 5 or the locking portion 4. The location of installation can be anywhere as long as the vibration damping member 8 is in contact with the strings 104 to suppress the unnecessary vibration sound.

As shown in FIG. 7C, when the vibration damping member 8 to be in contact with the strings 104 is divided into a plurality of parts corresponding to each string, the influence of the contact state of the neighboring string is eliminated. Thus, the vibration of the strings can be suppressed by applying an appropriate pressure to individual strings having different thickness and tension. As shown in FIG. 7D, when the vibration damping member 8 has a lamination structure formed by materials of different hardness so that at least a portion 8*a* to be in contact with the strings is made of an elastic body (e.g. urethane rubber) having wear resistance, the wear of the vibration damping member 8 can be prevented.

By using the present embodiment, the unnecessary vibration of the strings 104 can be suppressed by the vibration damping member 8. Thus, sound signal can be faithfully reproduced and rich sound can be reproduced.

Embodiment 7

Figure 8B:
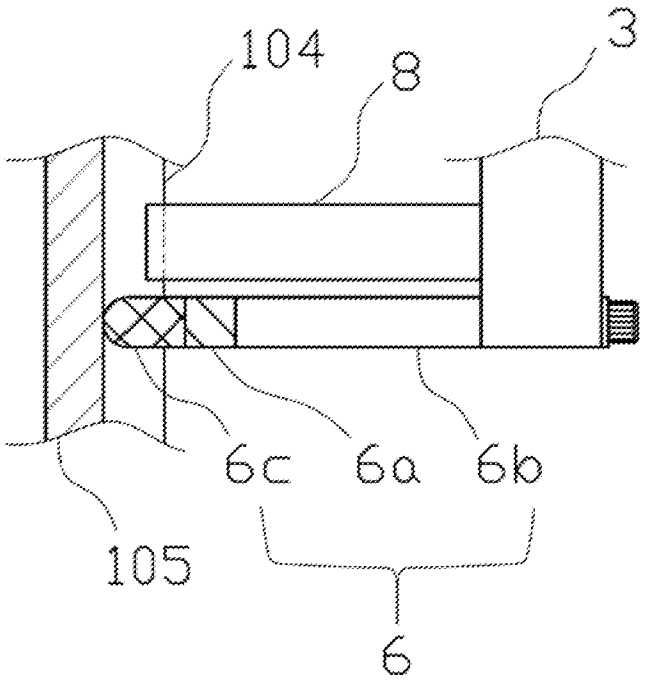
FIGS. 8A, 8B, 8C are side views
Figure 8A:
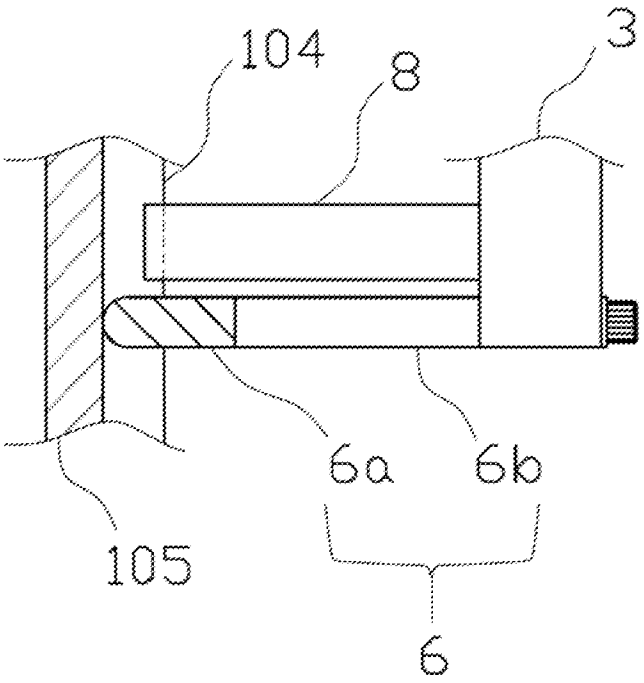
Figure 8D:
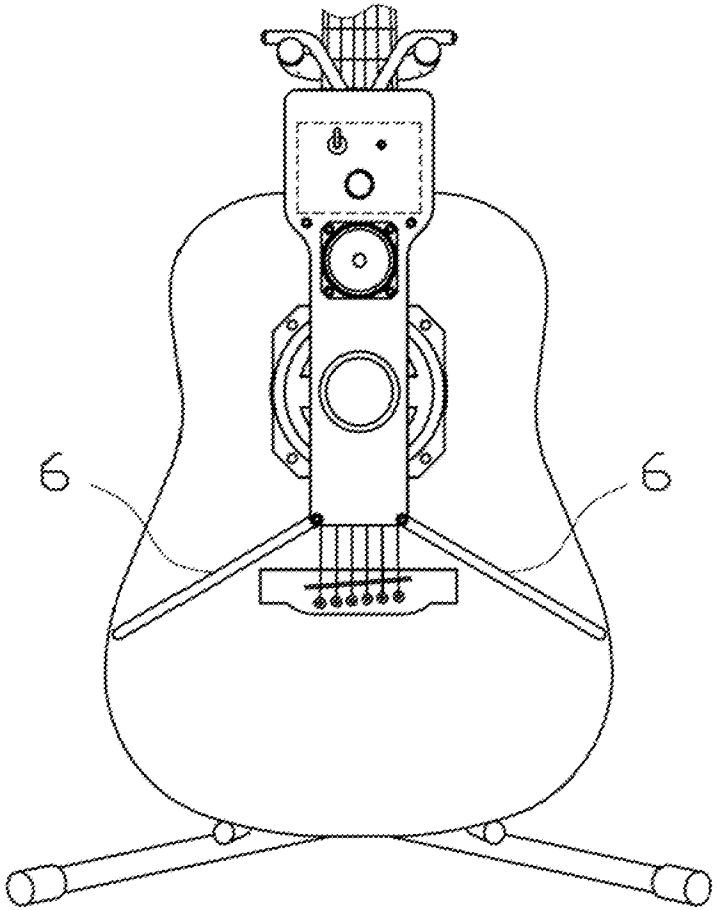
FIG. 8D is a front view of a spacer of the present embodiment.
Figure 8C:
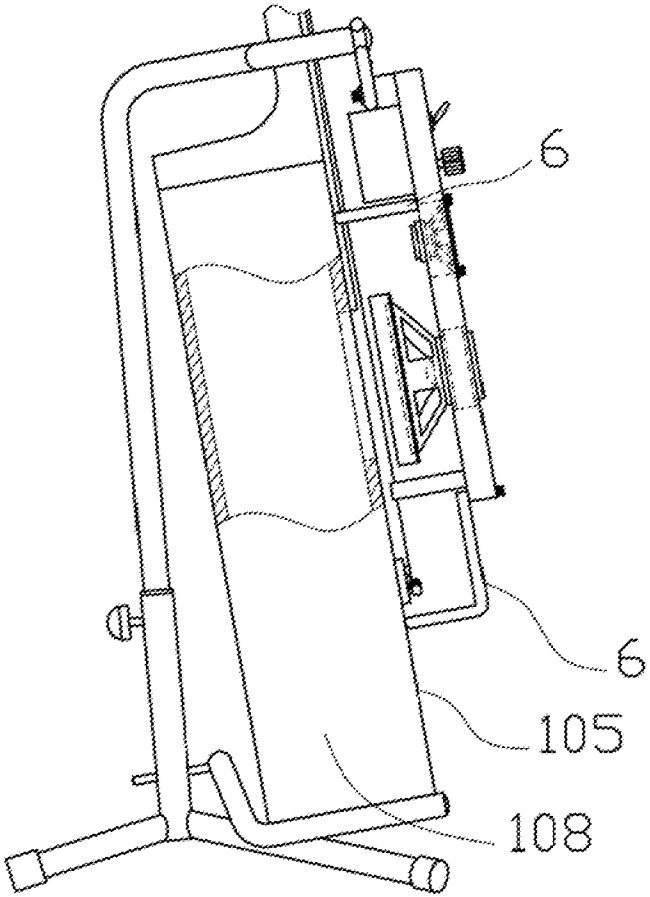

FIGS. 8A and 8B are side views of a spacer 6 of the present embodiment. FIG. 8C is a side view and FIG. 8D is a front view showing the case where the spacer 6 is extended. As for the material of the spacer 6, elastic bodies such as a urethane foam and butyl rubber are preferred not to prevent the vibration of the front plate 105 when the spacer 6 is in contact with the front plate 105. However, as shown in FIG. 8A, when only the portion to be in contact with the front plate 105 is made of an elastic body 6*a* and the other portions 6*b* are made of the hard materials having rigidity such as metal, synthetic resin and wood, the deformation of the spacer 6 is prevented and the clearance between the vibration generator 2 and the front plate 105 can be appropriately kept. As shown in FIG. 8B, when the spacer 6 has a lamination structure formed by materials of different hardness so that at least a portion 6*c* to be in contact with the strings is made of an elastic body (e.g. urethane rubber) having wear resistance, the wear of the spacer 6 can be prevented.

During the resonance, the periphery of the sound hole 109 and the bridge 106 is vibrated largely. Therefore, as shown in FIGS. 8C and 8D, it is preferred that the spacer 6 is extended to be in contact with around the joining portion of the front plate 105 and the side plate 108.

As shown in FIGS. 8C, 8D and other figures, if four spacers 6 are installed, the spacers 6 serve as fulcrums when the acoustic apparatus 1 is detached from the guitar 100 and placed on a table or the like. Thus, it is expected that the vibration generator 2 is prevented from contacting the table or the like and prevented from being damaged. On the other hand, the angle of the guitar 100 to be held by the stand 300 varies depending on the case. Therefore, the number of the spacers 6 can be two or the spacer 6 can be omitted when the acoustic apparatus 1 cannot be stably installed, or when the vibration damping member 8 is in contact with the strings 104 to appropriately keep the clearance 11 between the acoustic apparatus 1 and the front plate 105. The location of installing the spacer 6 is not limited to the support body 3. The location of installation can be anywhere as long as the clearance between the vibration generator 2 and the front plate 105 can be appropriately kept. For example, the spacer 6 can be installed on the frame 202 of the vibration generator 2 or the drive circuit 5.

By using the present embodiment, the clearance between the vibration generator 2 and the front plate 105 can be appropriately kept by the spacer 6. In addition, since free vibration of the front plate 105 is not restricted, sound signal can be faithfully reproduced and rich sound can be reproduced. Furthermore, the effect of preventing the damage of the vibration generator 2 can be also expected.

Embodiment 8

Figure 9B:
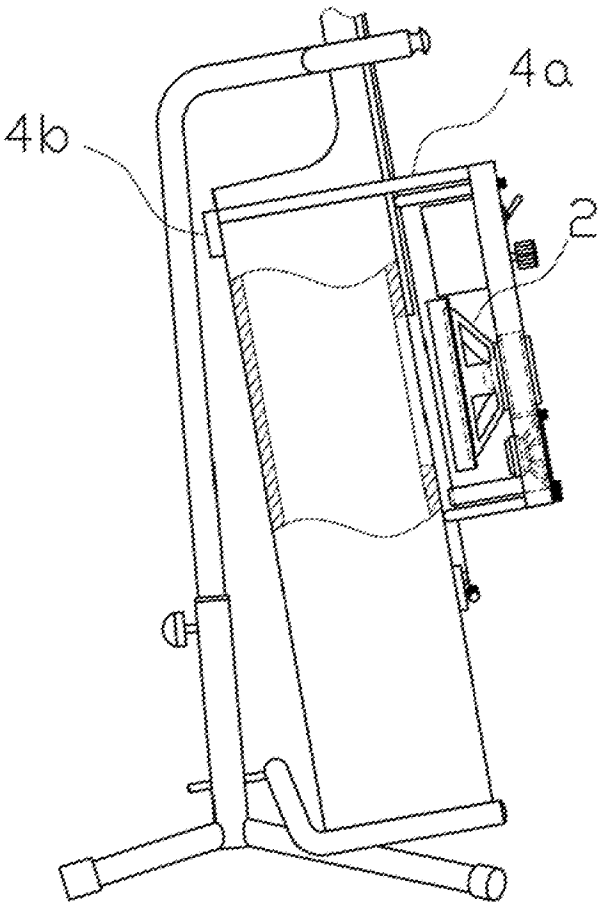
FIGS. 9A and 9C are rear views and FIGS. 9B and 9D are side views related to a method of installing the acoustic apparatus of the present embodiment.
Figure 9A:
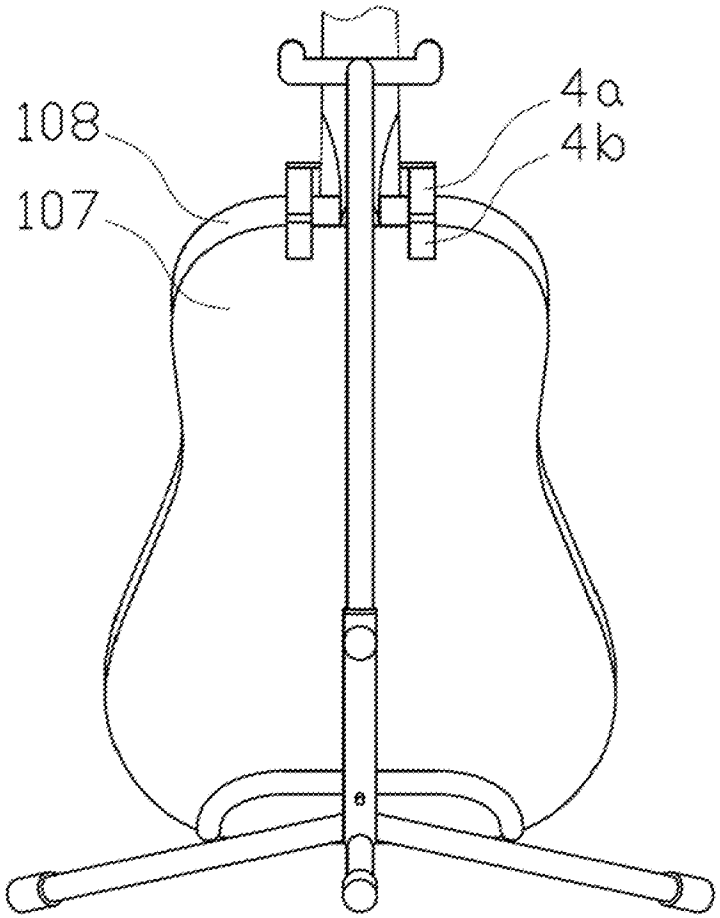
Figure 9D:
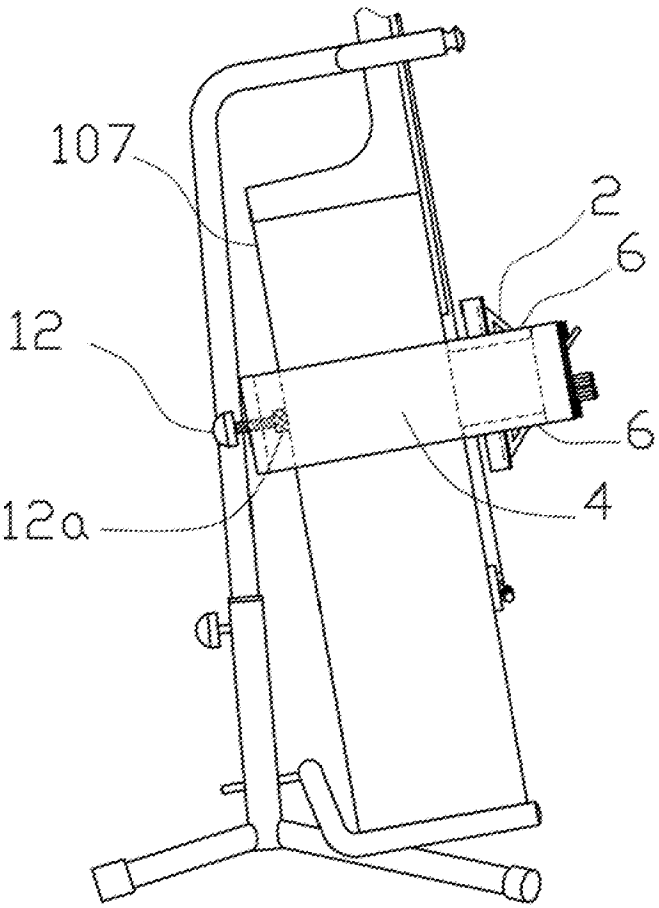
Figure 9C:
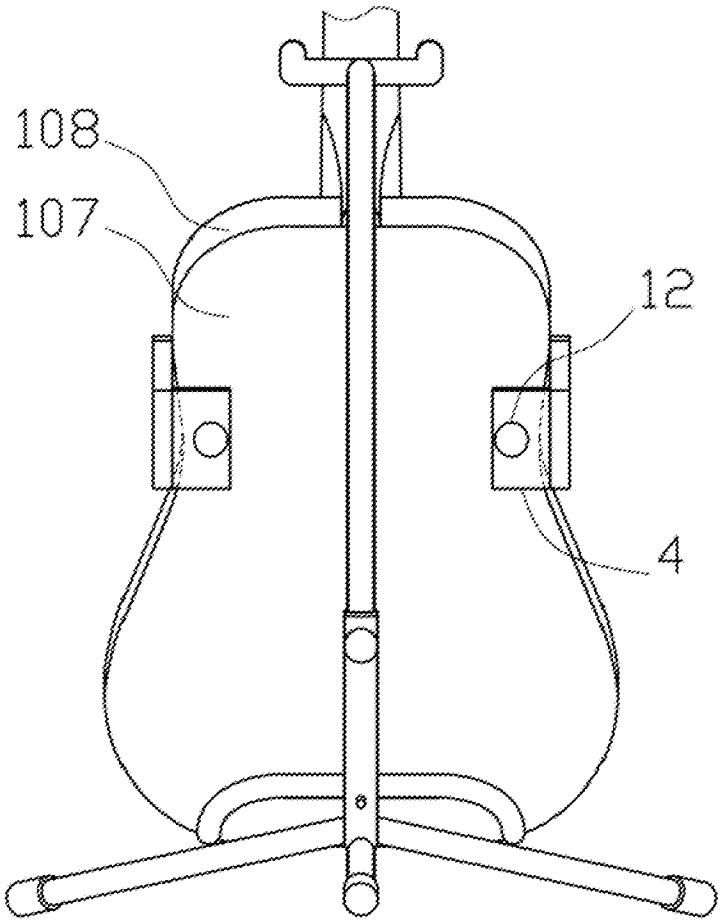

FIGS. 9A and 9C are rear views and FIGS. 9B and 9D are side views related to a method of installing the acoustic apparatus 1 of the present embodiment. As shown in FIGS. 9A and 9B, when the locking portions 4*a*, 4*b* of the acoustic apparatus 1 are directly in contact with the side plate 108 and the back plate 107 at an upper portion of the sound box 103, the acoustic apparatus 1 can be installed on the guitar 100 without depending on the shape of the stand 300 or even when the guitar 100 is leaned against the wall without providing a stand. The locking portion 4 is locked to both sides sandwiching the neck 102. Although it is not illustrated, when an elastic body is adhered to the portion to be in contact with the back plate 107 and the side plate 108, the damage of the sound box 103 and the displacement of the acoustic apparatus 1 can be prevented. When the elastic body capable of preventing the displacement of the acoustic apparatus 1 is adhered, the locking portion 4*a* to be in contact with the back plate 107 can be omitted.

As shown in FIGS. 9C and 9D, when the portion to be attached to the guitar 100 is formed by sandwiching the sound box 103 by, the locking portion 4, the spacer 6 and a screw 11 to be screwed in the locking portion 4 and in contact with the back plate 107, the acoustic apparatus 1 can be installed on the guitar 100 regardless of the posture of the guitar 100. At that time, the spacer 6 and the screw 12 are preferably in contact with the portion around the joining portion of the front plate 105, the back plate 107 and the side plate 108 not to prevent the vibration of the sound box 103. In addition, a portion 12*a* of the screw 12 to be in contact with the back plate 107 is preferably formed by an elastic body, a felt or the like to prevent the damage of the back plate 107.

Embodiment 9

Figure 10:
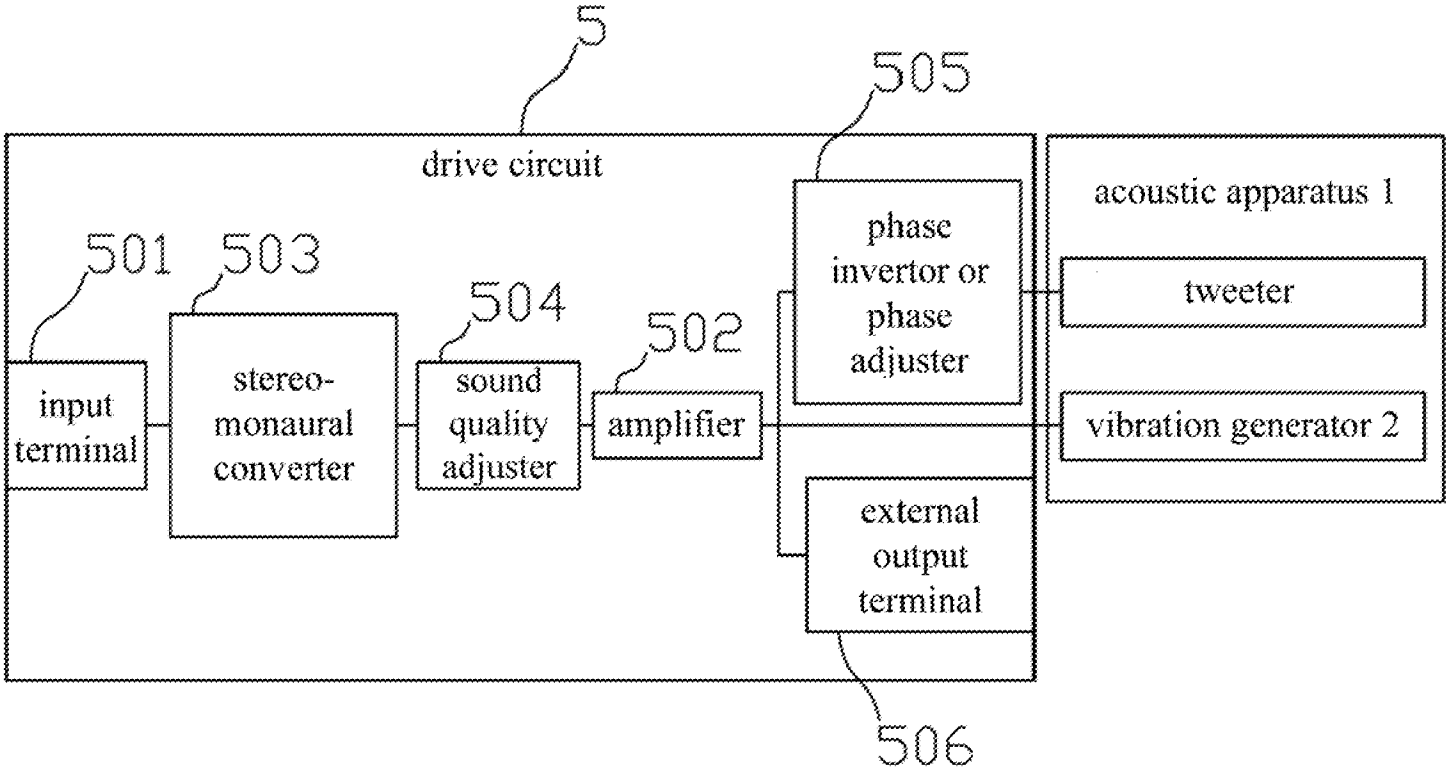
FIG. 10 is a block diagram showing a configuration of a drive circuit of the present embodiment.

FIG. 10 is a block diagram showing a configuration of the drive circuit 5 of the present embodiment. The drive circuit 5 is formed by an input terminal 501 that inputs the supplied sound signal, an amplifier 502 that amplifies the inputted sound signal and drives the vibration generator 2, and a not illustrated power source. When a sound quality adjuster 504 such as a tone control circuit and an equalizer is provided between the input terminal 501 and the amplifier 502, the frequency characteristic and phase characteristic of the sound wave emitted from the vibration generator 2 and the sound box 103 can be adjusted. Thus, more rich sound can be reproduced.

When the sound signal is inputted as an analog signal, a mini jack, a pin jack or the like is used as the input terminal 501. On the other hand, when the sound signal is inputted as a digital signal, a wireless communication means such as Bluetooth (registered trademark) and a wired communication means such as USB audio interface can be provided. On the other hand, when an amplifier for driving the vibration generator 2 is provided outside the acoustic apparatus 1, the drive circuit 5 can be omitted and the sound driving signal of the external amplifier can be directly inputted into the vibration generator 2.

When the installation direction of the diaphragm 201 of the vibration generator 2 is opposite to the installation direction of the diaphragm 401 of the tweeter 400 with respect to the listener, the phases of the emitted sound wave are opposite to each other. Thus, the listener may feel incompatibility. Therefore, it is preferred that the sound driving signal is inputted so that the phase of the sound wave emitted from the diaphragm 201 to the listener direction (+Z direction) has the same phase as the sound wave emitted from the diaphragm 401 to the listener direction (+Z direction). As the simplest way, it can be achieved by connecting wiring to the tweeter 400 so as to have reverse phases. (Namely, the amplifier 502 is connected to the tweeter 400 so that the plus and minus terminals of the sound driving signal of the amplifier 502 are opposite to the plus and minus terminals of the tweeter 400.) Alternatively, a phase inverter such as a switch can be provided to invert the polarity of the sound driving signal. Alternatively, a phase adjuster 505 capable of arbitrarily adjusting the phase can be provided instead of the switch or the like. In this case, the phase adjuster 505 also has a function of an amplifier for driving the tweeter 400. Although it is not illustrated, a high path filter for passing only the high frequency ranges is provided between the amplifier 502 and the tweeter 400.

By using the present embodiment, the phases of the sound wave emitted from the vibration generator 2 and the sound box 103 and the sound wave emitted from the tweeter 400 can be adjusted to the same phase or arbitrarily adjusted. Thus, incompatibility caused by the phase difference can be suppressed, and performance of generating the sound signal can be further improved.

Since the sound signal is generally a stereo signal, when one acoustic apparatus 1 of the present invention is used, monaural reproduction can be performed by providing a stereo-monaural converter 503 between the input terminal 501 and the amplifier 502. When two acoustic apparatuses 1 are arranged to reproduce the sound signal as a stereoscopic sound, an output terminal 506 can be provided to output the sound driving signal of the R or L channel which is opposite to the sound reproduced by the acoustic apparatus 1. The signal outputted to the output terminal 506 is not limited to the above example. The sound signals branched from the output of the input terminal 501 or the sound quality adjuster 504 can be also used. In addition, a plurality of acoustic apparatuses 1 can be connected to reproduce surround sound with realistic sensation.

Variation Example

Figure 11B:
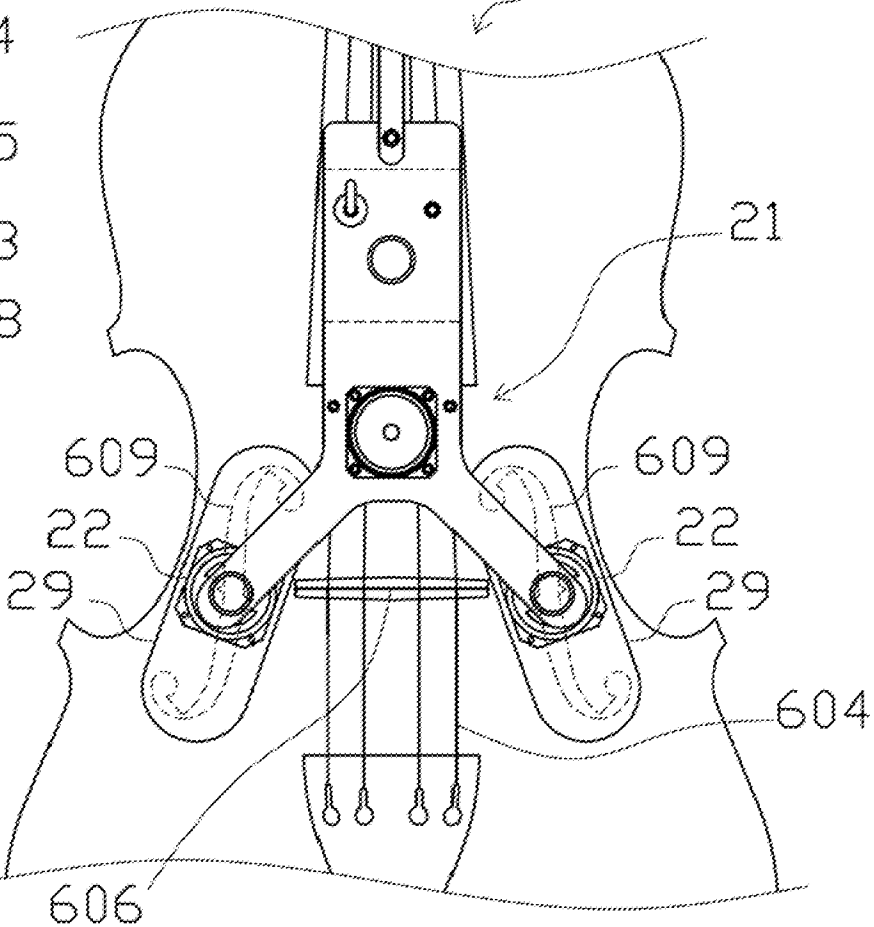
FIGS. 11A and 11C are side views and FIGS. 11B and 11D are front views showing a variation example of the present embodiment.
Figure 11A:
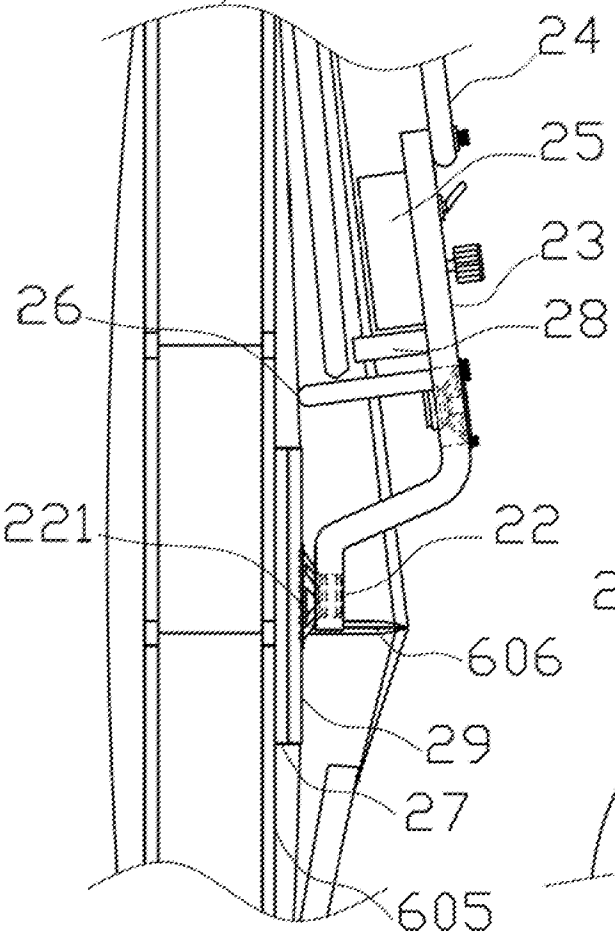
Figure 11D:
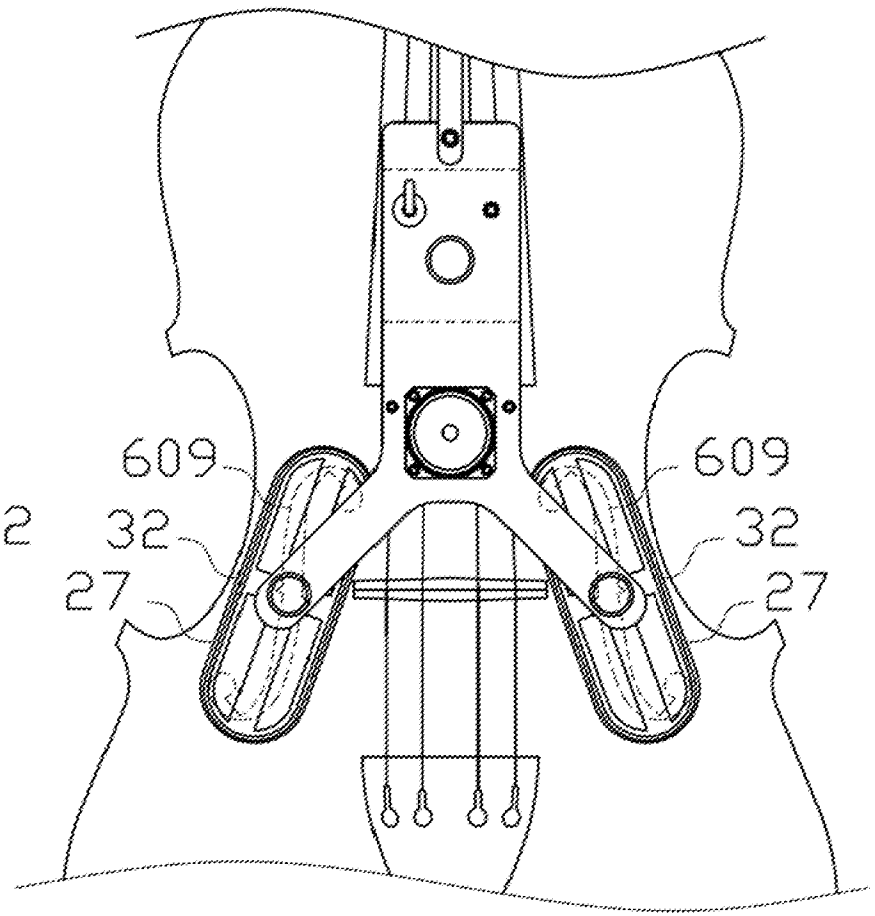
Figure 11C:
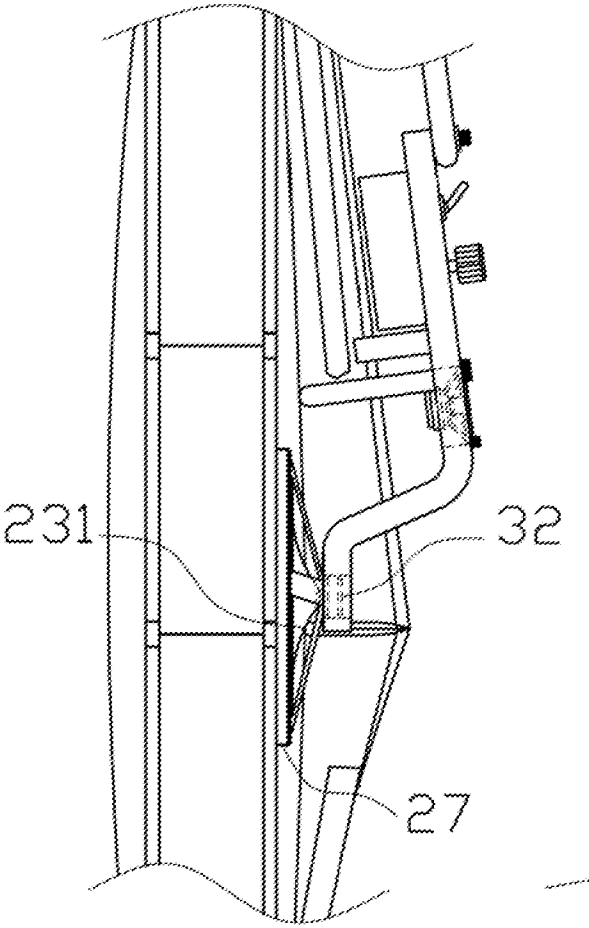

FIGS. 11A to 11D show a variation example where the musical instrument to install an acoustic apparatus 21 of the present embodiment is a violin 600. FIGS. 11A and 11C are side views and FIGS. 11B and 11D are front views. As shown in FIGS. 11A and 11B, the violin has f-shaped holes 609 (f-shaped resonance holes) on the right and left of the strings 604. In addition, compared to the guitar, a bridge 606 for transmitting the vibration of the strings 604 is higher and a clearance between the strings 604 and the front plate 605 is larger. Therefore, a vibration generator 22 of the acoustic apparatus 21 for the violin 600 is preferred to be arranged to face the right and left f-shaped holes 609 without arranged it above the strings 604. In addition, since the opening area of the f-shaped holes 609 is small, the vibration generator 22 is preferred to be arranged so that the f-shaped holes 609 is almost entirely closed in order to resonate a sound box 603 efficiently.

When a diaphragm 221 of the vibration generator 22 has a circular shape, the vibration generator 22 is attached to a baffle board 29 with an elliptical shape having a size covering the f-shaped holes 609. Thus, the vibration generator 22 is arranged to cover the f-shaped holes 609. For closing the f-shaped holes 609, a shielding member 27 can be formed on an approximately outer circumference of the baffle board 29 so as to be in contact with the sound box 603. As shown in FIGS. 11C and 11D, when a diaphragm 231 is formed in an elliptical shape, the baffle board 29 can be omitted and the sound pressure of the emitted sound can be increased. Thus, the sound box 603 can be resonated more efficiently.

The present embodiment can be applied to all stringed instruments having resonance holes on the right and left of the strings, without limited to the violin.

The already described embodiments 1 to 9 can be also applied to the violin and other stringed instruments having a plurality of resonance holes on the sound box. Also in such a case, the musical instrument can be resonated efficiently and the original sound of the musical instrument can be sufficiently reproduced.

DESCRIPTION OF THE REFERENCE NUMERALS

1, 21: acoustic apparatus
2, 22, 32: vibration generator
3, 23: support body
4, 24: locking portion
5, 25: drive circuit
6, 26: spacer
7, 27: shielding member
8, 28: vibration damping member
9: spacer for supporting frame
10: frame
11: clearance
29: baffle board
100: guitar
200: dynamic type speaker unit
300: stand
400: tweeter
500: drive circuit
600: violin

The invention claimed is:

1. An acoustic apparatus for resonating a musical instrument having a sound box and a sound hole to emit a sound wave from the musical instrument, the acoustic apparatus comprising:

a vibration generator which is configured to be arranged to face the sound box;

a support body for supporting the vibration generator; and a locking portion which is configured to be locked directly to the musical instrument or locked to a stand for holding the musical instrument, wherein the vibration generator has a diaphragm for converting a sound driving signal into an acoustic vibration, the vibration generator is configured to be spaced apart from a front surface of the sound hole, and the vibration generator is configured to be arranged to face the sound hole from an outside of the musical instrument.

2. The acoustic apparatus according to claim 1, the acoustic apparatus further comprising:

a spacer which is configured to be arranged between the sound box and the support body.

3. The acoustic apparatus according to claim 1, the acoustic apparatus further comprising:

a tweeter which is arranged on the support body to emit the sound wave toward an opposite direction of the vibration generator.

4. The acoustic apparatus according to claim 1, the acoustic apparatus further comprising:

a drive circuit for outputting the sound driving signal to the vibration generator.

5. The acoustic apparatus according to claim 4, wherein the drive circuit drives the vibration generator so that the sound wave emitted from the vibration generator and the sound wave emitted from the tweeter have a synchronized phase in a direction of emitting the sound wave from the sound box.

6. The acoustic apparatus according to claim 4, wherein the drive circuit has:

a phase inverting unit for inverting the phase of the sound driving signal outputted to the vibration generator with respect to the sound driving signal outputted to the tweeter; or a phase adjusting unit for adjusting the phase of the sound driving signal outputted to the vibration generator.

7. The acoustic apparatus according to claim 1, the acoustic apparatus further comprising:

a shielding member which is configured to be arranged between the vibration generator and the musical instrument to surround an outer periphery of the vibration generator.

8. The acoustic apparatus according to claim 1, wherein the musical instrument further has a plurality of strings, and the acoustic apparatus further has a vibration damping member which is in contact with the plurality of strings.

9. A musical instrument system, comprising:

a musical instrument having a sound box; and an acoustic apparatus according to claim 1.

* * * * *